US009415440B2

(12) United States Patent
Weiland et al.

(10) Patent No.: US 9,415,440 B2
(45) Date of Patent: Aug. 16, 2016

(54) METHODS OF MAKING A REINFORCED COMPOSITE AND REINFORCED COMPOSITE PRODUCTS

(75) Inventors: Hasso Weiland, Lower Burrell, PA (US); Men Glenn Chu, Export, PA (US)

(73) Assignee: Alcoa Inc., Pittsburgh, PA (US)

( * ) Notice: Subject to any disclaimer, the term of this patent is extended or adjusted under 35 U.S.C. 154(b) by 771 days.

(21) Appl. No.: 13/298,720

(22) Filed: Nov. 17, 2011

(65) Prior Publication Data

US 2012/0121890 A1 May 17, 2012

Related U.S. Application Data

(60) Provisional application No. 61/414,694, filed on Nov. 17, 2010, provisional application No. 61/414,701, filed on Nov. 17, 2010, provisional application No. 61/414,707, filed on Nov. 17, 2010.

(51) Int. Cl.

| | |
|---|---|
| ***B22D 19/14*** | (2006.01) |
| ***C22C 1/02*** | (2006.01) |
| ***C22C 1/10*** | (2006.01) |
| ***C22C 21/00*** | (2006.01) |
| ***C22C 21/06*** | (2006.01) |
| ***C22C 32/00*** | (2006.01) |

(52) U.S. Cl.

CPC ..... *B22D 19/14* (2013.01); *C22C 1/026* (2013.01); *C22C 1/1036* (2013.01); *C22C 21/00* (2013.01); *C22C 21/06* (2013.01); *C22C 32/0036* (2013.01); *C22C 32/0052* (2013.01); *C22C 32/0068* (2013.01); *C22C 32/0084* (2013.01); *Y10T 428/25* (2015.01)

(58) Field of Classification Search

CPC ..... B22D 19/14
USPC ..... 164/97
See application file for complete search history.

(56) References Cited

U.S. PATENT DOCUMENTS

| | | | |
|---|---|---|---|
| 3,632,792 | A | 1/1972 | Nielsen et al. |
| 3,918,141 | A | 11/1975 | Pepper et al. |
| 4,012,204 | A | 3/1977 | Riewald et al. |
| 5,259,436 | A | 11/1993 | Yun et al. |
| 5,401,338 | A | 3/1995 | Lin |
| 5,561,829 | A | 10/1996 | Sawtell et al. |
| 5,570,502 | A | 11/1996 | Sawtell et al. |
| 5,616,421 | A | 4/1997 | Sawtell et al. |

(Continued)

FOREIGN PATENT DOCUMENTS

| | | |
|---|---|---|
| WO | WO 98/56961 | 12/1998 |

OTHER PUBLICATIONS

International Search Report and Written Opinion of the International Searching Authority from corresponding international application No. PCT/US2011/061152 dated Jun. 14, 2012.

*Primary Examiner* — Kevin P Kerns
(74) *Attorney, Agent, or Firm* — Greenberg Traurig, LLP

(57) ABSTRACT

In some embodiments, the instant invention provides methods for making reinforced composites and reinforced composite products. In one embodiment, a method includes adding (a) a carrier including a salt and (b) a plurality of substantially inert sub-micron sized particles into a molten metal to form a mixture; and forming a reinforced composite from the mixture, the reinforced composite including a non-particulate metal portion having the substantially inert sub-micron sized particles therein.

20 Claims, 12 Drawing Sheets

(56) References Cited

U.S. PATENT DOCUMENTS

| | | | |
|---|---|---|---|
| 5,735,976 | A | 4/1998 | Chu et al. |
| 5,746,267 | A | 5/1998 | Yun et al. |
| 5,775,403 | A | 7/1998 | Premkumar et al. |
| 5,934,357 | A | 8/1999 | Sawtell et al. |
| 6,003,221 | A | 12/1999 | Sawtell et al. |
| 6,036,792 | A | 3/2000 | Chu et al. |
| 6,253,831 | B1 | 7/2001 | Genma et al. |
| 6,398,843 | B1 | 6/2002 | Tarrant |
| 6,773,513 | B2 | 8/2004 | Ludtka |
| 6,843,865 | B2 | 1/2005 | Chu et al. |
| 7,161,124 | B2 | 1/2007 | Kisner et al. |
| 7,161,126 | B2 | 1/2007 | Ripley |
| 7,358,469 | B2 | 4/2008 | Ripley |
| 7,509,993 | B1 | 3/2009 | Turng et al. |
| 7,601,294 | B2 | 10/2009 | Ripley et al. |
| 7,745,765 | B2 | 6/2010 | Kisner et al. |
| 7,767,943 | B2 | 8/2010 | Ripley |
| 7,909,907 | B1 | 3/2011 | Ripley et al. |
| 7,939,787 | B2 | 5/2011 | Ripley |
| 8,231,703 | B1 | 7/2012 | Seals et al. |
| 2007/0264149 | A1 | 11/2007 | Martinez Sanchez et al. |
| 2010/0098910 | A1 | 4/2010 | Naritomi et al. |
| 2010/0137491 | A1 | 6/2010 | Rose et al. |

METHODS OF MAKING A REINFORCED COMPOSITE AND REINFORCED COMPOSITE PRODUCTS

CROSS-REFERENCE TO RELATED APPLICATIONS

This patent application claims priority to U.S. Provisional Patent Application No. 61/414,694, filed on Nov. 17, 2010, U.S. Provisional Patent Application No. 61/414,701, filed on Nov. 17, 2010, and U.S. Provisional Patent Application No. 61/414,707, filed on Nov. 17, 2010, the contents of all of which are incorporated herein by reference in their entirety.

BACKGROUND

The majority of established aluminum products are being manufactured by ingot metallurgy. Typically, mechanical properties are obtained when alloying elements are precipitated as fine nanoparticles during thermo-mechanical processing. However, the optimum size and volume fraction to achieve maximum strength may change with variations in temperature. Further, the aluminum alloys can lose their optimized mechanical properties when exposed to elevated temperatures. Thus, high strength products and alloys may experience reduction of strength when used at elevated temperatures.

SUMMARY

Broadly, the instant disclosure is directed towards reinforced composite materials (sometimes called "enforced composites") and methods of making reinforced composite materials. More specifically, the instant disclosure is directed towards methods of making reinforced composite products which include substantially inert particles (e.g. sub-micron sized) therein.

With the addition of sub-micron sized-particles to metal alloys and/or metal products, the reinforced composite materials are believed to exhibit certain characteristics and/or properties attributable from the particles, including, for example: increased strength, increased tensile yield modulus, specifiable magnetic and/or electric conductor/insulator capabilities, as well as other desirable material properties. In some embodiments, these characteristics have varying degrees, as a function of the amount (e.g. vol. %) of sub-micron sized particles that are present in the reinforced composite. These characteristics and/or properties are not readily achievable, or readily maintained, with aluminum and precipitation hardened aluminum alloys.

Without being bound by a particular mechanism or theory, it has been found that without the use of a wetting aid (e.g. salt), sub-micron sized particles agglomerate at the top of the molten metal; thus the sub-micron sized particles are not mixed (e.g. dispersed) into the molten metal. As a result, it is believed that the sub-micron sized particles will not be incorporated into the final reinforced composite product. Also, without being bound to particular mechanism or theory, it is believed that without a wetting aid, the resulting particles carry contaminants with them into the reinforced composite product, possibly resulting in an inferior reinforced composite product. Further, though not being bound to a particular mechanism or theory, matrices having particles greater than 1 micron are believed to be an initiation site for grain fracture. Thus, in some embodiments, the reinforced composites include: well-dispersed amounts of sub-micron sized particles; a substantially contaminant free particle: metal interface; little to no initiated fracture sites in the grains, and combinations thereof.

"Agglomeration", as used herein, refers to a collection of mass which is the result of the gathering of various objects (e.g. non-dispersion of particles). In some embodiments, with the increased wettability of the molten metal, agglomeration of the particles is reduced, and the substantially inert sub-micron sized particles are dispersed therein more consistently and/or effectively. As such, agglomeration may be prevented, at least partially (and/or entirely) within the formed reinforced composite product.

As used herein, "reinforced" means to strengthen and/or support something with (or by) some additional material. In some embodiments, the particles reinforce the non-particulate metal portion (sometimes called the interconnected metal portion or the metal matrix) to support and/or promote the composite to a certain characteristic or property (e.g. electrical conductivity, strength, magnetic, etc.).

As used herein, "composite" refers to something that is made up of separate parts or elements. In some embodiments, the composite refers to the combination of the non-particulate metal portion having particles therein.

As used herein, "reinforced composite" refers to a material made of two or more parts/components, which is supported and/or strengthened by one of the components. In some embodiments, one material is a metal, while the other is a particulate (e.g. plurality of particles). As one non-limiting example, the reinforced composite product includes a metal portion (i.e. non-particulate metal portion) and a plurality of sub-micron sized particles (e.g. substantially inert at a particular vol. %, wt. %, or concentration) within the metal. In some embodiments, the reinforced composite comprises an oxide concentration that does not exceed a threshold value (i.e. particular amount), where the oxide concentration is measured with respect to the reinforced composite or the non-particulate metal portion (e.g. excluding the particulates).

As used herein, "metal" refers to an alloy or mixture composed wholly or partly of such substances (i.e. metal elements). A non-limiting example of a metal is aluminum, individually or in combination with selected alloying elements. For example, the alloying elements in the metal may be used to create various alloys, and/or may be utilized for processing purposes. In some embodiments, alloying elements may vary based on the desired final alloy properties and/or characteristics. In one or more embodiments of the present disclosure, alloy compositions in molten form may be designated by the Aluminum Association designation tables. Non-limiting examples of alloys that can be used in the reinforced composite include: those with the Aluminum Association designations: 1xxx (e.g. 1350), 3xxx (e.g. 3003, 3004), 5xxx (e.g. 5005, 5050, and 5252), 2xxx, 6xxx, 7xxx, and 8xxx.

As used herein, "non-particulate metal portion" refers to the metal portion of the reinforced composite, excluding the sub-micron sized particles. As one non-limiting example, the non-particulate metal portion is an aluminum metal and/or an aluminum alloy, with selected alloying elements. In some embodiments, the non-particulate metal portion is interconnected metal through which the sub-micron sized particles are dispersed.

As used herein, "molten" refers to a material in a liquefied state by (or through the application of) thermal energy (e.g. heat). In some embodiments, the metal (or metal alloy) is in molten form (i.e. above its liquidous temperature).

As used herein, "particle" refers to a small unit of a material. Various particles are usable with one or more embodiments of the instant disclosure to provide reinforced composites having particles therein (see, e.g. FIGS. 5-10 for different reinforced composites).

As used herein, "sub-micron sized particle" refers to a particle having a size of less than about one micron. In some embodiments, the particles include nanoparticles. In some embodiments, the sub-micron sized particles include: binary or multi-component compounds of ceramic, non-metallic, high temperature metallic particles, oxides, carbides, nitrides, borides, metals, and combinations thereof. In some embodiments, sub-micron sized particles include particles with: a melting point above the processing temperature of the molten metal (e.g. including aluminum), insolubility in molten metal (e.g. aluminum), intermetallic phases, and combinations thereof, to name a few.

In some embodiments, the sub-micron sized particles are: less than about 1 micron; or less than about 0.9 micron; or less than about 0.8 micron; or less than about 0.7 micron; or less than about 0.6 micron; or less than about 0.5 micron; or less than about 0.4 micron; or less than about 0.3 micron; or less than about 0.2 micron; or less than about 0.1 micron. In some embodiments, the sub-micron sized particles are: less than about 0.08 micron; or less than about 0.06 micron; or less than about 0.04 micron; or less than about 0.02 micron; or less than about 0.005 micron, or less than about 0.0001 micron. In some embodiments, sizes may refer to an average particle size or particle size limit.

In some embodiments, the sub-micron sized particles are: not greater than about 1 micron; or not greater than about 0.9 micron; or not greater than about 0.8 micron; or not greater than about 0.7 micron; or not greater than about 0.6 micron; or not greater than about 0.5 micron; or not greater than about 0.4 micron; or not greater than about 0.3 micron; or not greater than about 0.2 micron; or not greater than about 0.1 micron. In some embodiments, the sub-micron sized particles are: not greater than about 0.08 micron; or not greater than about 0.06 micron; or not greater than about 0.04 micron; or not greater than about 0.02 micron; or not greater than about 0.005 micron; or not greater than about 0.0001 micron. In some embodiments, sizes may refer to an average particle size or particle size limit.

As used herein, "aspect ratio" refers to the dimensions of the sub-micron sized particle geometry (e.g. length to width ratio). In some embodiments, the sub-micron sized particles have an aspect ratio. As previously discussed, For example, the aspect ratio may be in the form of the ratio of length to width (and/or diameter when used in conjunction with carbon nanotubes and/or fibers). Various aspect ratios are usable in conjunction with one or more embodiments of the instant disclosure in order to promote certain properties and/or characteristics in the reinforced composite product.

In some embodiments, the sub-micron sized particles have an aspect ratio of: at least about 1 to 1; at least about 2 to 1; at least about 3 to 1; at least about 4 to 1, at least about 5 to 1, at least about 6 to 1, at least about 7 to 1, at least about 8 to 1, at least about 9 to 1, at least about 10 to 1. In some embodiments, the aspect ratio is at least about 20 to 1; at least about 50 to 1; at least about 100 to 1; at least about 500 to 1; or at least about 1000 to 1.

In some embodiments, the sub-micron sized particles have an aspect ratio of: not greater than about 1 to 1; not greater than about 2 to 1; not greater than about 3 to 1; not greater than about 4 to 1, not greater than about 5 to 1, not greater than about 6 to 1, not greater than about 7 to 1, not greater than about 8 to 1, not greater than about 9 to 1, not greater than about 1 0 to 1. In some embodiments, the aspect ratio is not greater than about 20 to 1; not greater than about 50 to 1; not greater than about 100 to 1; not greater than about 500 to 1; or not greater than about 1000 to 1.

As used herein, "inert" refers to a material that is chemically inactive and has little to no ability to react chemically. As one non-limiting example, the particles used in the reinforced composites are substantially chemically inert in the molten metal, and thus, have little to no chemical reaction in the non-particulate metal portion of the reinforced composite.

As used herein, "substantially inert" refers to a material that is chemically inactive. However, a material is considered chemically inactive even though there are surface reactions (e.g. along the outermost portion of the particle body). In some embodiments, a substantially inert material does not undergo chemical transformation but can undergo surface reactions and/or interactions with the surrounding environment/material. In some embodiments, substantially inert sub-micron sized particles have surface reactions when placed into molten metal containing salt. In some embodiments, the surface reactions enhance bonding to the non-particulate metal portion (i.e. the metal in the reinforced composite, e.g. an aluminum or aluminum alloy matrix). In one embodiment, the surface reactions are not greater than about 5 wt, % of the particle. In one embodiment, the surface reactions are not greater than about 10 wt. % of the particle.

In some embodiments, the reinforced composite includes substantially inert particles mixed throughout. In some embodiments, the particles are not agglomerated in the reinforced composite. In some embodiments, the reinforced composite includes substantially inert particles dispersed throughout. As used herein, "dispersed" refers to spreading from a fixed (or constant) source. In some embodiments, the reinforced composite includes substantially inert particles distributed throughout. As used herein, "distributed" refers to dispersing something through an object or over an area. In some embodiments, the reinforced composite includes substantially inert particles uniformly spaced throughout. As used herein, "uniform" refers to something that is unchanging in form, quality and/or quality. In some embodiments, the reinforced composite includes substantially inert particles homogenously mixed throughout. In some embodiments, the reinforced composite includes substantially inert particles blended throughout. As used herein, "blended" refers to a smooth and inseparable mixture of two or more things.

As used herein, "salt" refers to any of a class of compounds (e.g. crystalline compounds) that are formed from (or can be regarded as formed from), an acid and a base by replacement of one or more hydrogen atoms in the acid molecules by positive ions from the base. In some embodiments, the salt is thermodynamically stable and/or compatible with the molten metal. In one non-limiting example, the salt is a halide salt of alkali and/or alkaline earth metals (e.g. including bromides, chlorides, and/or fluorides). In one aspect of the instant disclosure, a method of making a sub-micron sized reinforced composite is provided. In one embodiment, the method includes: forming a mixture which includes a salt and a molten metal, adding a plurality of substantially inert sub-micron sized particles into the mixture, and producing a reinforced composite having a plurality of sub-micron sized particles dispersed therein. In some embodiments, the reinforced composite has particular properties attributed to the particles.

In some embodiments, the salt is a binary mixture, a ternary mixture, or a quaternary mixture of salts. In one or more embodiments of the instant disclosure, salts are used in various phases, including solid form and/or liquid form (e.g. melted salt and/or dissolved salt in a solute). As one non-limiting example, the salt is in molten form. In some embodiments, the salt enables the incorporation of the particles into the final reinforced product. In some embodiments, the salt is not a part of the final product. Some non-limiting examples of the salt include halide salts having: Na, K, Ca, Mg, and Li. Some non-limiting examples of salts include: KCl, NaCl, MgCl, and combinations thereof. Various blends of salts are used in accordance with the various embodiments of the present method. In one embodiment, a salt is 50/50 KCl/NaCl salt blend. In one embodiment, 48% NaCl/48% KCl/2.2% MgCl/1/8% CaCl is used. In one embodiment, a 48% NaCl/48% KCl/2.2% MgCl/1/8% LiCl is used.

As used herein, "mixing" refers to the addition of two materials. In some embodiments, mixing of molten metal is completed by physical agitation in order to introduce one or more materials (e.g. salt, alloying elements, grain refiners, sub-micron sized particles) into the molten metal. In some embodiments, stirrers, impellers, and/or rods may be used to mix the particles with the molten metal. Additionally, in other embodiments, mixing is completed by ultrasound techniques, electromagnetic stirring, and combinations thereof. In some embodiments, the sub-micron sized particles are mixed into the molten metal (e.g. with salt) and distributed therein and/or throughout (e.g. dispersed, uniformly mixed, and/or homogenous, and/or blended).

As used herein, "mixture" refers to a combination or blend of different components. As a non-limiting example, a mixture includes at least two of; molten metal, sub-micron sized particles, and/or salt. In other embodiments, the mixture includes salt and molten metal. In other embodiments, the mixture includes salt and sub-micron sized particles. In other embodiments, the mixture includes molten metal and sub-micron sized particles. In some embodiments, one or more of the aforementioned combinations also includes inert gas.

As used herein, "adding" refers to the act of combining one thing with another. In one embodiment, adding refers to the physical combination of the particles to the molten metal, while maintaining their structure and/or function of the particles. In some embodiments, adding includes the mechanical combination or material of the substantially inert sub-micron sized particles with the molten metal. In some embodiments, adding includes the steps of wetting (e.g. with a wetting aid) and/or mixing. In one non-limiting example, salt and substantially inert sub-micron sized particles are mixed into a molten metal to (e.g. simultaneously effecting melting of the salt and dispersing of the particles into the molten metal).

As used herein, "wetting" refers to the ability of a substance to reduce the surface tension of another substance (e.g. liquid). In some embodiments, wetting causes a solid (e.g. molten metal) to spread across or penetrate more easily into the surface of a liquid. In some embodiments, wetting enables the particles to penetrate the molten metal. In some embodiments, wetting enables the particles to enter the molten metal. In some embodiments, wetting enables dispersion of particles into the molten metal but prevents contaminants from entering.

As used herein "wetting aid" refers to a substance or device that assists in the wetting of a material. In some embodiments, one or more types of wetting aids are usable in a wetting step to combine sub-micron sized particles with molten metal. Some non-limiting examples of wetting steps/wetting aids include: a direct addition to a wetted molten metal; a carrier substance addition, container addition, and combinations thereof (i.e. added to the melt).

As used herein, "carrier substance" refers to a material that carries a material (e.g. attached or otherwise affiliated to its surface) into another material or object. In some embodiments, carrier substances carry the sub-micron sized particles into the melt (i.e. the molten metal). In some non-limiting examples, the carrier substance is in a solid phase (e.g. salt, solid parent metal), a liquid phase (e.g., molten salt, molten metal), a gaseous phase (e.g., an inert gas like argon, nitrogen, and/or other non-reactive gases and combinations thereof, etc.), and/or combinations thereof. In some embodiments, the carrier substance is a wetting aid and/or is used in the wetting step.

Some non-limiting examples of solid carrier substances include: inorganic materials and/or halogenated compounds (e.g. salts), metals, soluble materials and/or insoluble (e.g. immiscible) materials. Some non-limiting examples of metals include, for example, aluminum, silicon, magnesium, nickel, carbon and others, while immiscible materials include, for example tin (e.g. removable from the melt after sub-micron sized particle addition).

In some embodiments, the sub-micron sized particles are added to the melt (e.g. the molten metal) with a carrier substance. In some embodiments, volume fractions greater than about 10 vol. % are combinable with the carrier substances, either as a powder mixture of particles and carrier substance (e.g. silicon powder or coarse grained silicon powder). As non-limiting examples, the powder is either in loose or compressed form. In other embodiments, the carrier substance is in molten (e.g. molten metal) to which the sub-micron sized particles are added (e.g. molten silicon carbon as carrier substance). In other embodiments, the sub-micron sized particles are added to a non-powder carrier substance, including as a non-limiting example, a solid (i.e. non-powder) form of a carrier substance (e.g. an aluminum sheet).

As used herein, "container" refers to an object used for (or capable of) holding another material. Various shapes, thicknesses, dimensions, etc can be used in accordance with various methods of adding sub-micron sized particles to the molten metal. In some embodiments, the container is used to hold the sub-micron sized particles and transfers the particles into the molten metal. In some embodiments, the container encloses the sub-micron sized particles (and/or an inert gas) and the container is added to the molten metal to release the sub-micron sized particles into the molten metal.

In some embodiments, the container dissolves into the molten metal, burns off from the molten metal, evaporates from the molten metal, breaks apart/dissipates and/or combinations thereof to release the sub-micron sized particles into the molten metal. In some embodiments, the container includes a vent. In some embodiments, the vent directs the effects of the molten metal and/or reduces the effects of adding a closed vessel (i.e. pressurized system) to the molten metal (i.e. high temperature material). In some embodiments, the residual (i.e. ambient) air is removable from the container by pumping the air out from the container (e.g. vacuum seal) and/or displacing the air with inert gas prior to closing the container (e.g. by sealing the container or mechanically attaching the container lid).

As one non-limiting example, the container is made of aluminum, and the aluminum dissolves upon addition of the container to the molten metal, releasing the sub-micron sized particles to the molten metal. A non-limiting example includes: an aluminum container (e.g. can) with a lid (e.g. sealable lid) that can be filled with particles and secured (e.g. sealed, welded, mechanically fastened, or combinations thereof) prior to addition to the molten metal. As another non-limiting example, the container is made of a combination of grain refiners and/or alloying elements (e.g. in combination with aluminum or individually).

As used herein, "producing" refers to making a material from one or more components. As one non-limiting example, the producing step includes one or more process steps, which result in creating a solid metal (e.g. metal product) from a molten metal. In some embodiments, the solid reinforced composite product (e.g. the metal with particles therein) is extruded to form rod, bar, tube, wire, etc. In some embodiments, the reinforced composite is rolled to form a plate, a sheet, or a foil. In some embodiments, the reinforced composite is cast into shapes (e.g. formed into a final form through shape casting).

In one aspect of the instant disclosure, a method is provided. The method comprises: adding (a) a carrier comprising a salt and (b) a plurality of substantially inert sub-micron sized particles into a molten metal to form a mixture; and forming a reinforced composite from the mixture, the reinforced composite comprising a non-particulate metal portion having the substantially inert sub-micron sized particles therein.

In one embodiment, due to the adding step, the reinforced composite comprises an oxide concentration of less than about 100 ppm in the metal portion. In one embodiment, the sub-micron sized particles are selected from the group consisting of: nanoparticles, carbon nanotubes, magnetic sub-micron sized particles, non-metallic sub-micron sized particles, ceramic particles; and combinations thereof.

In one embodiment, the forming step comprises a reinforced composite product having particles with an average aspect ratio of about 1:5. In one embodiment, the reinforced composite comprises not greater than 25 vol. % of sub-micron sized particles. In one embodiment, the reinforced composite comprises having not less than 0.1 vol. % of sub-micron sized particles therein.

In another aspect of the instant disclosure, a method is provided. The method comprises: forming a mixture comprising a carrier and a molten metal, wherein the carrier includes a salt; adding a plurality of substantially inert sub-micron sized particles into the mixture; and producing a reinforced composite from the mixture, the reinforced composite comprising a non-particulate metal portion having a plurality of substantially inert sub-micron sized particles in the non-particulate metal portion.

In one embodiment, the forming step comprises melting a container into the molten metal, wherein the container encloses the carrier. In one embodiment, the producing step further comprises making a product selected from the group consisting of: a wrought product, a cast product, an extruded product, a machined product, and combinations thereof.

In another aspect of the instant disclosure, a method is provided. The method comprises: forming a mixture comprising a salt and a plurality of substantially inert sub-micron sized particles; adding the mixture to a molten metal; and producing a reinforced composite having a plurality of sub-micron sized particles in a non-particulate metal portion.

In one embodiment, the forming step further comprises: cooling a molten salt having sub-micron sized particles to an amorphous solid having sub-micron sized particles enclosed in the salt.

In one embodiment, the forming step further comprises: mixing the solid salt with the sub-micron sized particles to form a commingled mixture.

In another aspect of the instant disclosure, a reinforced composite product prepared by the process is provided, comprising the steps of: adding (a) a carrier comprising a salt and (b) a plurality of substantially inert sub-micron sized particles into a molten metal to form a mixture; and forming a reinforced composite from the mixture wherein the reinforced composite comprises a non-particulate metal portion having a plurality of substantially inert sub-micron sized particles, where the particles comprise an aspect ratio of at least 1:5, further wherein at least one of the non-particulate metal portion and the particles comprise an oxide level not exceeding about 100 ppm.

In one embodiment, the reinforced composite further includes at least 2 vol. % of substantially inert sub-micron sized particles therein. In one embodiment, the plurality of substantially inert sub-micron sized products comprise carbon nanotubes.

In another aspect of the instant disclosure, a reinforced composite is provided. The reinforced composite includes: a metal alloy (e.g. a non-particulate metal portion), wherein the metal alloy includes a plurality of substantially inert sub-micron sized particles dispersed therein. In some embodiments, the metal alloy includes an oxygen concentration (e.g. oxide concentration) of the metal alloy of less than about 100 ppm. In some embodiments, the sub-micron sized particles are present in at least about 0.01 vol. %. In some embodiments, the sub-micron sized particles are present in not greater than about 30 vol. %.

DETAILED DESCRIPTION

Figure 1:
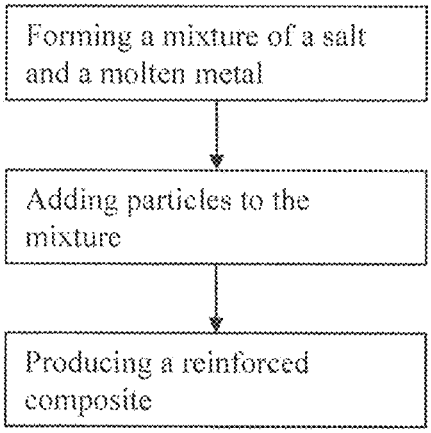
FIG. 1 depicts a method for making reinforced composites according to an embodiment of the present disclosure.

Referring to FIG. 1, a method for making a reinforced composite is provided. The method comprises forming a mixture of salt and molten metal. In one embodiment, a solid salt is added to the molten metal (e.g. to the surface or beneath the surface of the metal). In one embodiment a liquid (e.g. melted) salt is added to the molten metal. In some embodiments, the mixture of molten metal and salt are mixed (e.g. with an impeller or stirrer).

Next, the method comprises adding a plurality of particles (e.g. substantially inert sub-micron sized particles) to the mixture. In some embodiments, the adding step includes a co-addition of salt and the particles. In other embodiments, the adding step includes a co-addition of particles with a carrier substance, like an inert gas, or a solid material (e.g. silicon particles or grain refiners). In various embodiments, the inert gas is blanketed over the top of the melt, bubbled into the melt (e.g. with the particles) or a combination thereof. In some embodiments, inert gas is directly flowed (e.g. at a flow rate) into and/or across the surface of the melt. In some embodiments, the adding step comprises adding a container to the mixture, wherein the container encloses the plurality of particles (e.g. individually or in combination with a carrier substance like salt or a gas). In some embodiments, adding further includes mixing the particles, by one or more of the various embodiments provided above.

Once the particles are mixed and/or otherwise dispersed through the molten metal, the method further comprises producing a reinforced composite. In some embodiments, the producing step comprises removing the top layer from the molten metal (e.g. containing the contaminants, salts, and impurities) to yield the molten metal/particle mixture, followed by solidifying metal/particle mixture to form a reinforced product. In some embodiments, the reinforced composite is cast, molded, extruded, rolled, and/or machined various products. In some embodiments, the particles retained in the metal matrix (e.g. the non-particulate metal portion) are substantially inert, in that the particles retain their composition. In some embodiments, the particles include no surface reactions and/or negligible amounts of small-scale surface reactions. In some embodiments, the area surrounding the sub-micron sized particles is substantially free from contaminants, including, for example, oxides in some embodiments, the reinforced composite is substantially free from contaminants.

Figure 2:
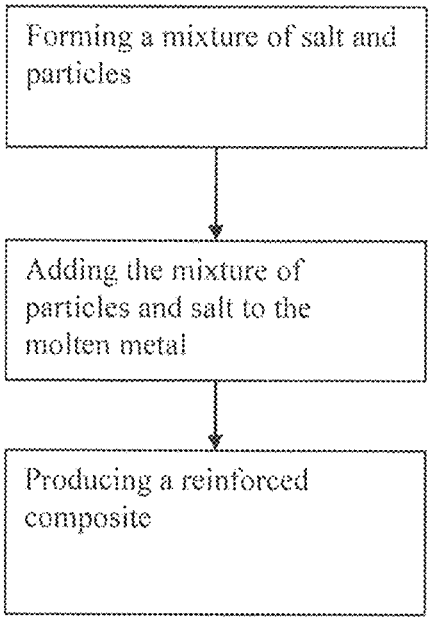
FIG. 2 depicts a method for making reinforced composites according to another embodiment of the present disclosure.

Referring to FIG. 2, another method of making a reinforced composite is provided. The method comprises forming a mixture of salt and particles (e.g. substantially inert sub-micron sized particles). In one embodiment, the mixture is a heterogeneous mixture of solid salt commingled with a plurality of substantially inert sub-micron sized particles (i.e. solid admixed with solid). In one embodiment, the salt is melted and the particles are admixed with the salt to provide an amorphous solid or plurality of amorphous solid fused salt pieces having particles therein. In some embodiments, the mixture is formed on the surface of the molten metal, by subsequent additions of the salt, followed by the particles.

In some embodiments, the sub-micron sized particles are added directly to an untreated melt surface with a carrier substance (e.g. salt, inert gas) or container (e.g. solid container, to enclose the particles). In some embodiments, the container and/or carrier substances assist in wetting and thus, promote incorporation of and dispersion of the particles into the molten metal. In some embodiments, direct addition is followed by salt addition and stirring (e.g. mechanical stirring, ultrasonic stirring, electromagnetic stirring, and/or combinations thereof). Next, the method comprises adding the mixture of particles and salt to the molten metal. In some embodiments, direct addition is followed by stirring the molten metal and sub-micron sized particles to mix (e.g. disperse) the sub-micron sized particles into the melt. In other embodiments direct addition is followed by pumping the sub-micron sized particles into the molten metal with a pump (e.g. an auger pump or a gear pump). In some embodiments, the pumping is completed with an inert gas, a salt, or combinations thereof. Adding is completed as set forth in one or more of the various embodiments, above. After the adding step, the producing step is completed, as set forth in one or more embodiments above.

Figure 3:
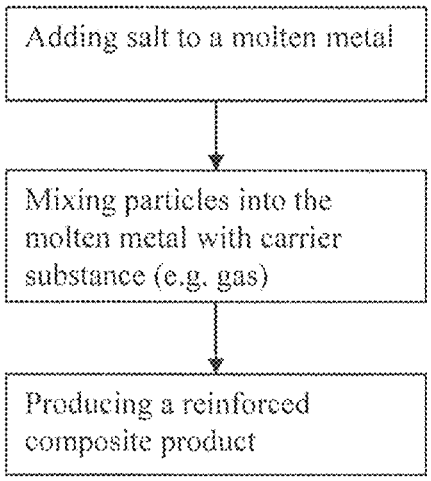
FIG. 3 depicts a method for making reinforced composites according to yet another embodiment of the present disclosure.

Referring to FIG. 3, another method of making a reinforced composite is provided. The method comprises adding the salt to a molten metal. In various embodiments, the salt is added individually or in combination with, for example, alloying elements, grain refiners, and/or an inert gas. In some embodiments, salt is added to the surface, below the surface (e.g. by an addition tube or impellor) or combinations thereof. Following the adding step, the method comprises mixing the particles into the molten metal with carrier gas. In some embodiments, the carrier gas blankets/covers the surface of the molten metal, e.g. to prevent an oxide layer from forming, and the particles pass through the layer of inert gas into the molten metal. In other embodiments, the particles are added into the molten metal with a carrier gas (e.g. inert gas), as with the two being added by an impellor, while being mixed into the molten metal. After the mixing step, the method comprises producing the reinforced composite product. The producing step includes one or more embodiments, as set forth above.

Figure 4:
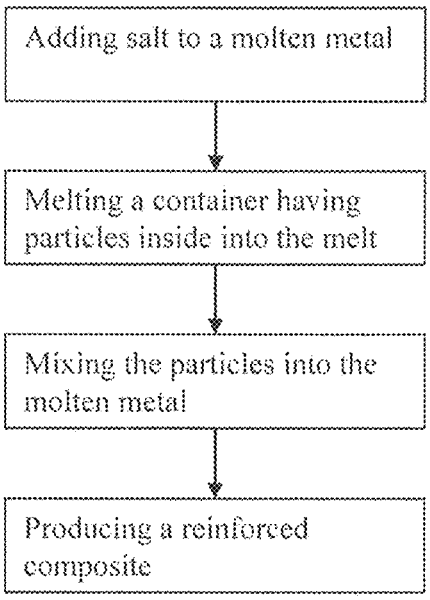
FIG. 4 depicts a method for making reinforced composites according to still yet an embodiment of the present disclosure.

Referring to FIG. 4, another method of making a reinforced composite is provided. The method includes adding a salt to a molten metal, which includes one or more of the various embodiments, as set forth above and melting a container having particles (and in some embodiments, gas) therein into the melt. The method further comprises the step of mixing the particles into the molten metal and producing a reinforced composite, which include one or more of the various embodiments for mixing and producing, as set forth above.

Table I provides an exemplary list of many types of particles used in one or more embodiments of the instant disclosure. It should be noted that this list is non-exhaustive and also that the particle sizes listed (max) refer to examples of sizes only, and that each particle listed is available in various sizes and should not be limited to the size referenced below,

TABLE I

Sub-Micron Sized Particles

| Particle | Particle Size (max), nm |
|---|---|
| Magnesium aluminate (e.g. spinel) | 50 |
| Magnesium hydroxide | 100 |
| Aluminum nitride | 50, 100 |
| Aluminum oxide ($Al_2O_3$) | 10, 20-30, 40-80 |
| Aluminum oxide (e.g. whiskers) | 2-4 × 2800 |
| Aluminum titanate | 25 |
| Silica | 20 |
| Silicon carbide (SiC) | 100 |
| Silicon dioxide (e.g. spherical and/or porous) | 5-15 |
| Silicon dioxide | 15, 20, 80 |
| Silicon dioxide, alumina doped nanoparticles | 50, 100 |

TABLE I-continued

| Sub-Micron Sized Particles | |
|---|---|
| Particle | Particle Size (max), nm |
| Silicon nitride (SiN) | 50 |
| Calcium oxide | 160 |
| Calcium phosphate (amorphous) | 150 |
| Calcium titanate | 100 |
| Calcium zirconate | 50 |
| Titanium carbide (TiC) | 200 |
| Titanium carbonitride | 150 |
| Titanium nitride | 20 |
| Titanium silicon oxide | 50 |
| Titanium(IV) oxide | 100 |
| Titanium(IV) oxide (anatase) | 25 |
| Titanium(IV) oxide (rutile and anatase) | 75 |
| Nickel chromium oxide | 50 |
| Nickel zinc iron oxide | 100 |
| Nickel(II) oxide | 50 |
| Copper aluminum oxide | 100 |
| Copper-zinc alloy, (56-60% Cu 37-41% Zn) | 150 |
| Yttrium(III) oxide | 50 |
| Gadolinium oxide (e.g. $Gd_2O_3$) | 15-30, 20-80 |
| Copper oxide (e.g. CuO) | 30-50 |
| Tungsten oxides (e.g. $WO_3$) | 30-70 |
| Molybdenum oxides (various types) (e.g. $MoO_3$) | 100 |
| Zirconium(IV) silicate | 100 |
| Aluminum cerium oxide | 50 |
| Cerium(IV) oxide | 25 |
| Tungsten | 150 |
| Tungsten carbide (WC) | 60 |
| Bismuth(III) oxide | 90-210 |
| Boron Carbide ($B_4C$) | 50 |
| Nickel | 20, 30-50 |
| Selenide | 1-15 |
| $V_2O_5$ | 30 |
| C—BN | 60 |
| $WS_2$ | 50 |

In some embodiments, the substantially inert sub-micron sized particles are carbon nanotubes (CNTs). "CNTs", as used herein, refer to cylinders made up of pure carbon molecules with unique properties. The cylinders may be single-walled, or have a plurality of walls (in other words, multi-walled), In some embodiments, CNTs may be metallic or semi-conducting (depending, for example, on the chirality of the CNTs).

TABLE II

| Select Carbon Nanotube Properties in Comparison to a Selected Aluminum Alloy | | | | | | |
|---|---|---|---|---|---|---|
| Material | Young's Modulus (TPa) | Tensile Strength (GPa) | Elongation (%) | Vol. Density (g × cm−3) | Electrical Conductivity Siemens/cm | Thermal Conductivity (watt-m/kelvin) |
| SWNT | 1-5 | 13-53 | 16 | 1.3-1.4 | 1E+04 to E+10 | <6000 |
| MWNT | 0.8-0.9 | 150 | 4.5% | 1.3-1.4 | 0.18E+04 | <6000 |
| AA 7050, T7451 4.75" | 0.07 | 0.5 | 10-12 | 2.7 | 2.3E+07 | 300 |

SWNT: Single Wall Nanotubes,
MWNT: Multi Wall Nanotubes,
Geometry: Diameter: 10 nm, Length≈10-100 μm.

TABLE II (above) references carbon nanotube properties measured in the axial direction of the CNTs (e.g. along the length of the tube). The measured properties are lower in the radial direction (e.g. along the tube diameter).

In some embodiments, the substantially inert sub-micron sized particles are metal fibers (e.g. metallic fibers). Fibers, as used herein, refer to components having an elongated shape (i.e. longer than wider). In some embodiments, the fibers are defined by an aspect ratio, as set forth above. In some embodiments the fibers include alumina fibers, including for example, nano-scale or nano-sized alumina fibers. In some embodiments, nano-alumina fibers are made of pure alumina. As some non-limiting examples, the fibers include one or more of the components listed in Table 1 above.

In some embodiments, the nano-alumina fibers range from 5 to 100 nm in diameter, and from 50 nm to 25 mm in length. In some embodiments, the nano-alumina fibers have a diameter of at least about 5 nm; at least about 10 nm; at least about 15 nm; at least about 20 nm; at least about 30 nm; at least about 40 nm; at least about 50 nm; at least about 60 nm; at least about 70 nm; at least about 80 nm; at least about 90 nm, or at least about 100 nm. In some embodiments, the nano-alumina fibers have a diameter of: not greater than about 5 nm; not greater than about 10 nm; not greater than about 15 nm; not greater than about 20 nm; not greater than about 30 nm; not greater than about 40 nm; not greater than about 50 nm; not greater than about 60 nm; not greater than about 70 nm; not greater than about 80 nm; not greater than about 90 nm, or not greater than about 100 nm.

In some embodiments, the nano-alumina fibers have a length of: at least about 50 nm; at least about 100 nm; at least about 250 nm; at least about 500 nm; at least about 1000 nm; at least about 5,000 nm; at least about 10,000 nm; at least about 25,000 nm; at least about 50,000 nm; at least about 100,000 nm; at least about 0.25 mm; at least about 0.5 mm; at least about 1 mm; at least about 5 mm; at least about 10 mm; at least about 15 mm; at least about 20 mm; or at least about 25 mm. In some embodiments, the nano-alumina fibers have a length of: not greater than about 50 nm; not greater than about 100 nm; not greater than about 250 nm; not greater than about 500 nm; not greater than about 1000 nm; not greater than about 5,000 nm; not greater than about 10,000 nm; not greater than about 25,000 nm; not greater than about 50,000 nm; not greater than about 100,000 nm; not greater than about 0.25 mm; not greater than about 0.5 mm; not greater than about 1 mm; not greater than about 5 mm; not greater than about 10 mm; not greater than about 15 mm; not greater than about 20 mm; or at least about 25 mm.

In some embodiments, the fibers are whiskers (e.g. monocrystalline whiskers). As used herein, "monocrystalline whisker" refers to a filament of material that is structured as a single crystal. In some embodiments, the filament is defect-free. Non-limiting examples of whisker materials include: graphite, alumina, iron, silicon, and combinations thereof. In some embodiments, the single-crystal whiskers have a tensile strength on the order of about 10-20 GPa. In some embodiments, the reinforced composite includes whiskers. In some embodiments, the reinforced composites whiskers that are defect-free.

In some embodiments, the fibers are added or mixed as bundles of fibers. In some embodiments, through one or more steps of the various methods, the bundles are incorporated into the final reinforced composite product. In some embodiments, the bundles are separated such that individual fibers are incorporated into the final reinforced composite product. In some embodiments, one or more of the method steps break apart the bundles of fibers and/or the individual fibers into sub-component particles, where the individually or in combination, the fibers and/or particles from the fibers comprise substantially inert sub-micron sized particles. In some embodiments, the reinforced composite product includes a combination of bundles of fibers, individual fibers, and sub-components of a fiber (e.g. broken fiber pieces), and combinations thereof.

In some embodiments, the substantially inert particles may be dispersed throughout the reinforced composite material such that the sub-micron sized particles have an average spacing constraint (constant spacing within a certain parameter) from one to another within the composite (e.g. dependent upon the concentration of particles in a composite).

In some embodiments, the sub-micron sized particles are dispersed throughout the reinforced composite randomly, measureable only by volume percent of addition. In some embodiments, the particles are randomly spaced from one another, but each particle contacts the non-particulate metal portion (e.g. is surrounded by the metal matrix, and does not touch the particles.) In some embodiments, the sub-micron sized particles are dispersed throughout the reinforced composite in a sufficient distribution to indicate a measureable characteristic or presence of a property or feature which is imparted on the reinforced composite by the substantially inert particles.

In some embodiments, the particles are embedded into the non-particulate metal portion such that at least one of the particles/the metal portion are substantially free from the contaminants. As one-non-limiting example, oxides are one type of contaminant that is prevented in the final reinforced composite product.

The reinforced composite may include an amount of substantially inert sub-micron sized particles therein. In some embodiments, the substantially inert submicron sized particles are present in: at least about 0.01 vol. %; at least about 0.1 vol. %; at least about 0.2 vol. %; at least about 0.3 vol. %; at least about 0.4 vol. %; at least about 0.5 vol. %; or at least about 1.0 vol. % substantially inert sub-micron sized particles therein. In some embodiments, the substantially inert submicron sized particles are present in an amount of: at least about 2.0 vol. %; at least about 5 vol. %; at least about 10 vol.%; at least about 15 vol. %; or at least about 20 vol. %. In other embodiments, the substantially inert sub-micron sized particles may exceed 20 vol. % of the reinforced composite, as may be desired.

The reinforced composite may include an amount of substantially inert sub-micron sized particles therein. In some embodiments, the substantially inert submicron sized particles are present in: not greater than about 0.01 vol. %; not greater than about 0.1 vol. %; not greater than about 0.2 vol. %; not greater about 0.3 vol. %; not greater than about 0.4 vol. %; not greater than about 0.5 vol. %; not greater than about 1.0 vol. % substantially inert sub-micron sized particles therein. In some embodiments, the substantially inert submicron sized particles are present in an amount of: not greater than about 2.0 vol. %; not greater than about 5 vol. %; not greater than about 10 vol.%; not greater than about 15 vol. %; or not greater than about 20 vol. %. In other embodiments, the substantially inert sub-micron sized particles may exceed 20 vol. % of the reinforced composite, as may be desired.

In some embodiments, the oxygen level of the non-particulate metal portion of the reinforced composite is: less than about 4,000 ppm; or less than about 1,000 ppm; or less than about 500 ppm; or less than about 200 ppm. In some embodiments, the oxygen concentration of the non-particulate portion is: less than about 180 ppm; or less than about 160 ppm; or less than about 140 ppm; or less than about 120 ppm. In some embodiments, the oxygen concentration of the non-particulate portion is: less than about 100 ppm; or less than about 80 ppm; or less than about 60 ppm; or less than about 50 ppm; or less than about 40 ppm; or less than about 30 ppm; or less than about 25 ppm; or less than about 20 ppm; or less than about 15 ppm; or less than about 10 ppm, or less than about 5 ppm.

In some embodiments, the oxygen level of the non-particulate metal portion of the reinforced composite is: not greater than about 4,000 ppm; or not greater than about 1,000 ppm; or not greater than about 500 ppm; or not greater than about 200 ppm. In some embodiments, the oxygen concentration of the non-particulate portion is: not greater than about 180 ppm; or not greater than about 160 ppm; or not greater than about 140 ppm; or not greater than about 120 ppm. In some embodiments, the oxygen concentration of the non-particulate portion is: not greater than about 100 ppm; or not greater than about 80 ppm; or not greater than about 60 ppm; or not greater than about 50 ppm; or not greater than about 40 ppm; or not greater than about 30 ppm; or not greater than about 25 ppm; or not greater than about 20 ppm; or not greater than about 15 ppm; or not greater than about 10 ppm, or not greater than about 5 ppm.

In some embodiments, the reinforced composite is characterized and/or assessed by one or more methods. Non-limiting examples of non-limiting measurement and/or characterization methods include: electron microscopy (either scanning or transmission); quantitative metallography (e.g. used in combination with stereology). In some embodiments, established methods of analytical electron microscopy can be employed, including, for example, Energy Electron Loss Spectroscopy (EELS) or Energy Dispersive X-Ray Spectroscopy (EDS). When the sub-micron sized particles are non-oxide materials, oxygen analysis methods can measure the entire composite (i.e. non-particulate metal portion+sub-micron sized particles) for oxide concentration/presence. When the sub-micron sized particles include oxides, the oxygen content of the reinforced composite is competed by measuring between the nanoparticles (i.e. the non-particulate metal portion).

In some embodiments, by forming a reinforced composite containing substantially inert sub-micron sized particles, certain types of particles will contribute to the tensile modulus, tensile elongation, strain-to-failure (including as example 1: deep drawing and 2: energy absorption (both indicators used in measuring crash worthiness and ballistics), compression values, and/or tensile yield strength of the resulting reinforced composite.

"Tensile modulus", as used herein, refers to the ratio of uniaxial stress over the uniaxial strain in the range of stress in which Hook's Law holds. This can be experimentally determined from the slope of a stress-strain curve created during tensile tests conducted on a sample of the material. In some embodiments, a reinforced composite exhibits increased tensile modulus over the metal/alloy alone.

"Tensile elongation", as used herein, refers to the percentage of increase in length that occurs before a material breaks under tension and/or loading. In some embodiments, the reinforced composite exhibits increased tensile elongation over the metal/alloy alone.

"Tensile yield strength", as used herein, refers to the stress at which material strain changes from elastic deformation to plastic deformation. For example, plastic deformation causes the material to deform, at least to some extent, permanently. Tensile yield strength is measured in accordance with ASTM B557, which is incorporated herein by reference in its entirety. In some embodiments, the reinforced composite exhibits increased tensile yield strength over the metal/alloy alone.

Figure 11:
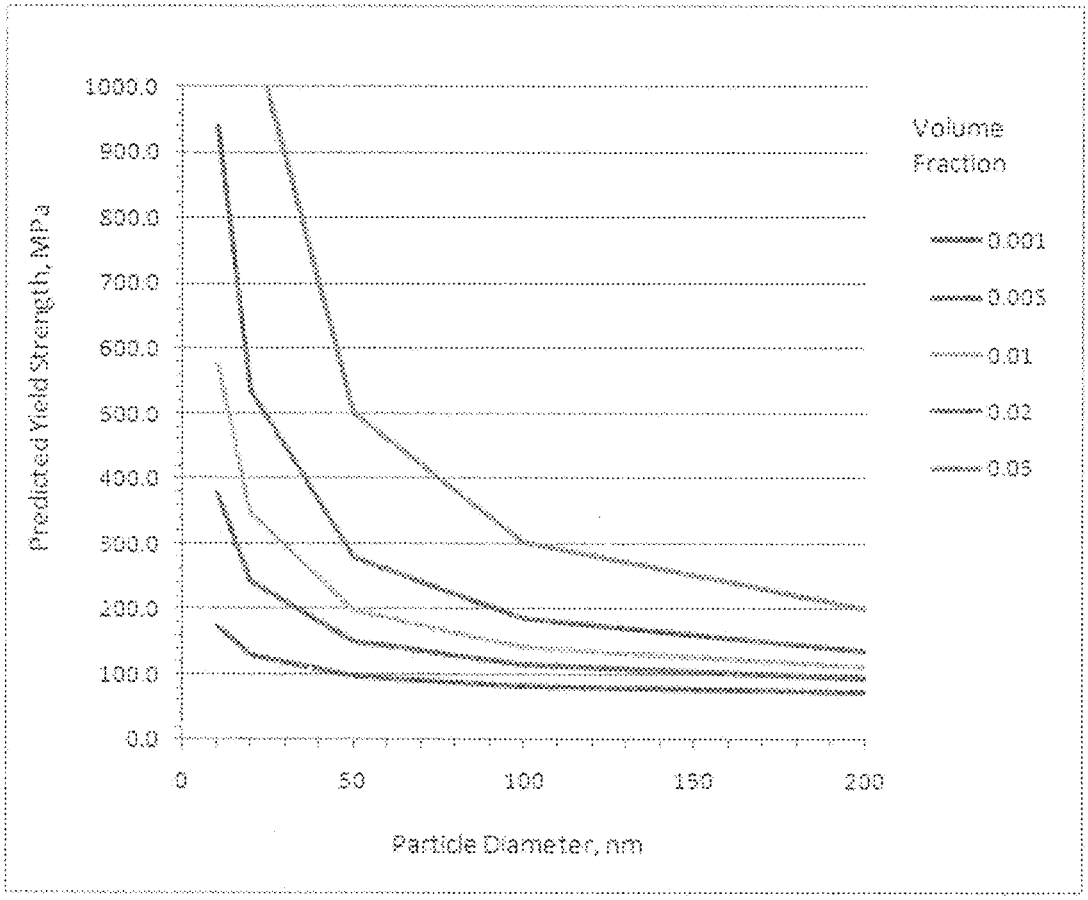
FIG. 11 depicts the calculated potential increases in yield strength for different volume fractions of sub-micron sized particles in the solid aluminum, from 0.1 vol. % to 5 vol. %.

In some embodiments, an amount of substantially inert sub-micron sized particles is added which is sufficient to increase the tensile yield strength of the resulting reinforced composite product by: at least about 1 MPa; at least about 3 MPa; at least about 5 MPa; at least about 7 MPa; at least about 8 MPa; at least about 10 MPa; or at least about 15 MPa. In some embodiments, the increase in tensile yield strength of the resulting reinforced composite product may be at least about 50 MPa; 100 MPa; three-hundred, five-hundred, seven-hundred, one-thousand, or more. FIG. 11 depicts the predicted tensile yield strength of reinforced composite materials based on the particle diameter of the sub-micron sized particles (at different volume fractions). As the particle diameter increases, the predicted yield strength decreases for all volume fractions of reinforced composite materials plotted.

In some embodiments, an amount of substantially inert sub-micron sized particles is added which is sufficient to increase the tensile yield strength of the resulting reinforced composite product by: not greater than about 1 MPa; not greater than about 3 MPa; not greater than about 5 MPa; not greater than about 7 MPa; not greater than about 8 MPa; not greater than about 10 MPa; or not greater than about 15 MPa. In some embodiments, the increase in tensile yield strength of the resulting reinforced composite product may be not greater than about 50 MPa; 100 MPa; three-hundred, five-hundred, seven-hundred, one-thousand, or more.

In some embodiments, an amount of the sub-micron sized particles within the reinforced composite may have an orientation within the metal alloy to contribute to load-bearing in the reinforced composite. In some embodiments, the sub-micron sized particles generally align their ends with the direction that a force (or load) is applied to at least the reinforced composite material. In one example, a cast reinforced composite with sub-micron sized particles having an aspect ratio, there will be a portion of sub-micron sized particles with their ends within a certain range of the loading angle (or axis) of the force or stress. In some embodiments, sub-micron sized particles have a load-bearing orientation when their ends (or when referring to the body, their axes) are within a certain tolerance from the axis of load.

In some embodiments, sub-micron sized particles are load bearing that are within: at least about 30° degrees from a loading angle; at least about 25° from a loading angle; at least about 20° from a loading angle; at least about 18° from a loading angle; at least about 15° from a loading angle; or at least about 10° from a loading angle on the reinforced composite. In some embodiments, load-bearing orientation may refer to particles being within: at least about 7° from a loading angle; at least about 5° from a loading angle; or in general alignment with the loading angle on the reinforced composite.

Figure 9:
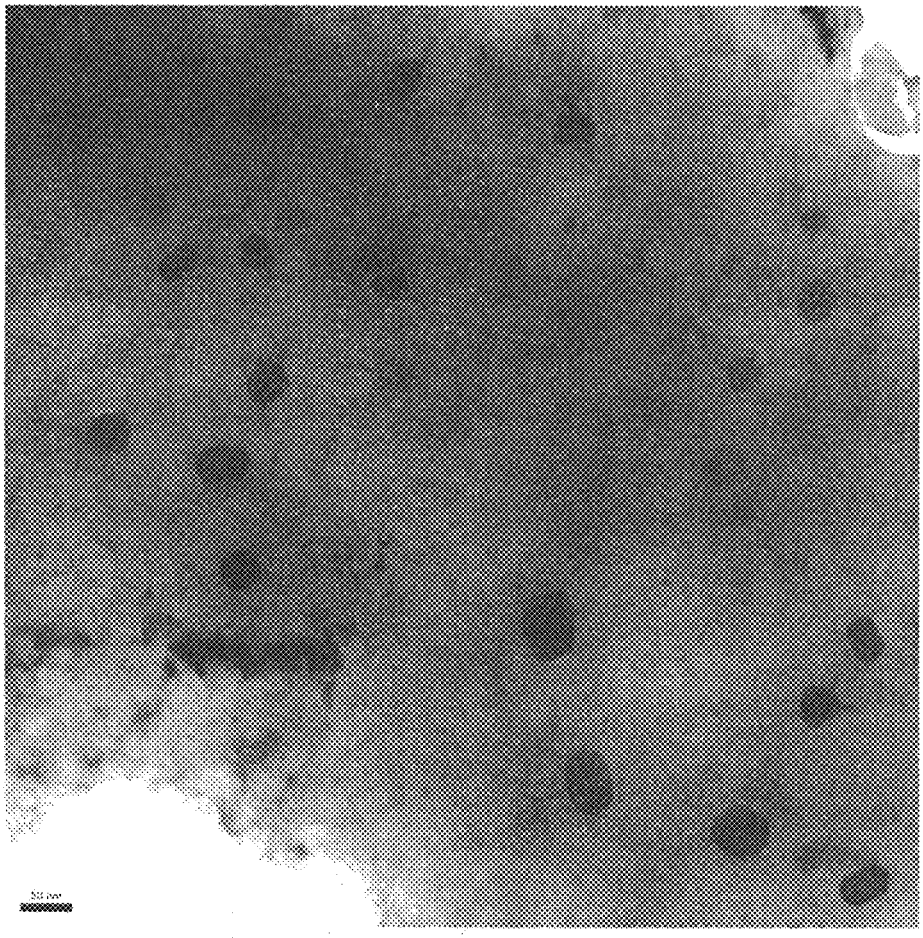
FIG. 9 depicts silicon carbide particles (average particle size 50 nm) embedded within a non-particulate metal portion (AA1350), yielding the reinforced composite product.
Figure 10:
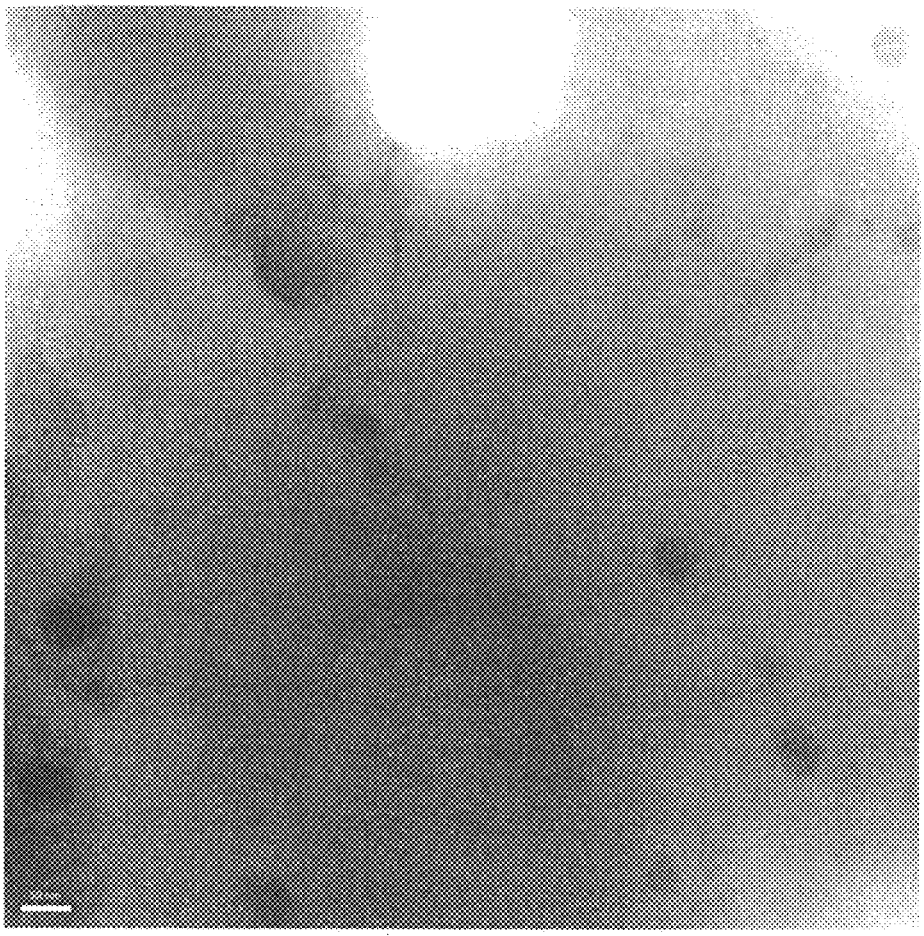
FIG. 10 depicts aluminum oxide particles dispersed within a reinforced composite product in accordance with the instant disclosure, where the aluminum oxide particles are approximately 10 nm in diameter.

In some embodiments, the sub-micron sized particles contribute to one or more properties of the resulting reinforced composite when in a random distribution throughout the non-particulate metal portion. Without being bound to a particular mechanism or theory, possible mechanisms to explain the increase in strength include: direct load transfer and/or dispersion strengthening by dislocations (obstacle to dislocations). For example, dispersion strengthening includes the metal deformation inside the reinforced composite by dislocations (e.g. Orowan loops) which act as defects in the grain structure of the non-particulate metal portion. FIG. 9 depicts some of these dislocations as Orowan loops (i.e. three dimensional loops) around the carbon nanotube.

In one embodiment, the sub-micron sized particles may contribute to the effectiveness of maintaining strength and tensile yield properties at increased temperatures. Also, sub-micron sized particles may enhance elongation while not affecting strength (e.g. added at a small enough volume fraction to not contribute/affect strength of the non-particulate metal portion).

In some embodiments, the reinforced composite material may cause an increase in desirable material properties without a loss in damage tolerance properties. Additionally, in some embodiments, as the size and shape of the substantially inert particles do not change at temperatures below the solidus of any aluminum alloy, the resulting reinforced composites are believed to have a significant increase in mechanical properties at elevated temperatures (i.e. where current aluminum alloys and aluminum products may be less desirable and/or fail). In some embodiments, processing times may also be reduced with the eliminated need of steps, including: preheating, annealing, and/or aging. In some embodiments, the substantially inert sub-micron sized particles may also contribute to additional characteristics and/or features of the reinforced product, including magnetic properties and/or electric properties. In other embodiments, the reinforced composite exhibits an increased magnetism over the metal/metal alloy. In other embodiments, the reinforced composite exhibits a decreased magnetism over the metal/metal alloy, but with. In other embodiments, the reinforced composite exhibits an increased electrical conductivity over the metal/metal alloy. In other embodiments, the reinforced composite exhibits a decreased electrical conductivity over the metal/metal alloy.

As some non-limiting examples, applications for the reinforced composites include consumer electronics, aerospace, electrical conductor products, solar cells, marine plate, and/or automotive sheet, to name a few. As a non-limiting example, in consumer electronics, the addition of carbon nanotubes to aluminum products has the potential to produce highly thermally conductive heat sinks, which is beneficial in this area. In the area of aerospace applications, for example, the strengthening phases with a quantity of substantially inert sub-micron sized particles may contribute to strengthening phases of aerospace products and materials. In the electrical conductor products area, for example, the addition of carbon nanotubes to aluminum products may have the potential to increase the electrical conductivity of electrical conductor products while simultaneously increasing the yield strength of these products. In the electrical conductor products area, for example, the addition of nanoparticles to aluminum products may have the potential to essentially maintain the electrical conductivity of electrical conductor products while simultaneously increasing the yield strength of these products. In some embodiments, the addition of the metallic particles may create embodiments of reinforced composites that are weak magnet aluminum products.

Other advantages to reinforced composites include, as non-limiting examples: elevated/high temperature strength; corrosion resistant (no solute depletion at grain boundaries). In some embodiments, the reinforced composite materials are weldable, as the reinforced composites have no solutionizing in a heat affected zone. In some embodiments, the reinforced composite materials are producible with a shorter preheat and/or the elimination of processing steps including solutionizing and/or aging.

In some embodiments, aluminum with nanoparticle additions have the potential to create high-strength products for elevated temperature applications, which maintain a significant portion of their property above 0.5 $T_m$, (300° C.).

These and other aspects, advantages, and features of the disclosure are set forth in part in the description that follows and will become apparent to those skilled in the art upon examination of the following description and figures, or may be learned by practicing the various embodiments of the disclosure. Reference will now be made in detail to the accompanying drawings, which at least assist in illustrating various pertinent embodiments of the present disclosure.

EXAMPLES

Example 1

A Process for Making Reinforced Composites

One experimental flowpath for making a reinforced composite is provided. Once the metal (e.g. aluminum) is melted into molten form, optional alloying elements are added to the melt. Then the melt is treated with salt. Salt is added to the melt, and an oxide layer forms over the top of the melt, the resulting oxide layer including impurities (e.g. dirt and/or salt). The oxide layer is skimmed from the surface. Optionally, additional salt (and/or inert gas) is added to the melt surface to protect the surface from oxidation. Next, sub-micron sized particles are added to the melt. The melt (with sub-micron sized particles) is stirred (e.g. mechanically, ultrasonically, and/or electromagnetically) to disperse the particles throughout the melt. The melt is then solidified to form a cast product by casting. The cast product can be fabricated to form wrought products by working

Example 2

Method of Making Reinforced Composite Having Nanoparticles

A melt was prepared with the target composition of aluminum containing 0 to 2.5% Mg and potentially other alloying elements at a temperature of at least about 700° C. The molten metal was then treated with salt, and the resulting oxide layer/top layer of the melt was skimmed in order to create a fresh surface. A pure NaCl:KCl (50:50 by weight) salt mixture was added, such that a continuous cover of the melt surface by molten salt was obtained. As the melt was stirred (e.g. in a controlled fashion), a predetermined quantity of sub-micron sized particles were added the final vol. % as determined by the targeted volume traction of sub-micron sized particles in the final reinforced composite product. The stirring time was determined by the volume fraction of sub-micron sized particles added to the melt (e.g. stir time is proportional to the quantity of particles). After stirring, the melt was poured into a mold and solidified for further processing using established methods. Any remaining salt was removed from the surface of the melt prior to pouring.

FIGS. 1 and 2 are the resulting reinforced composite products which have carbon nanotubes as the sub-micron sized particles at 0.1 vol. %.

Figure 5:
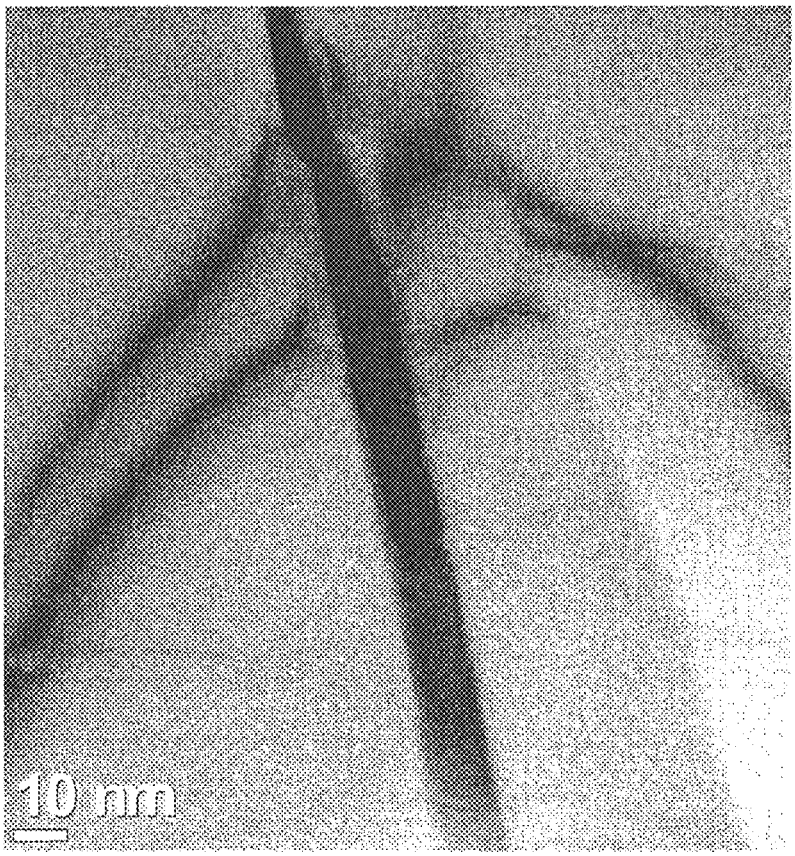
FIG. 5 is a transmission electron microscopy micrograph of one embodiment of a reinforced composite in accordance with the present disclosure. More particularly, the micrograph depicts a sub-micron sized particle (i.e. carbon nanotube) embedded in a non-particulate metal portion (i.e. aluminum alloy AA1050) in accordance with the instant disclosure.

FIGS. 3, 4, and 5 depict alumina as the sub-micron sized particle in an aluminum non-particulate metal portion at 0.1 vol. %.

Figure 6:
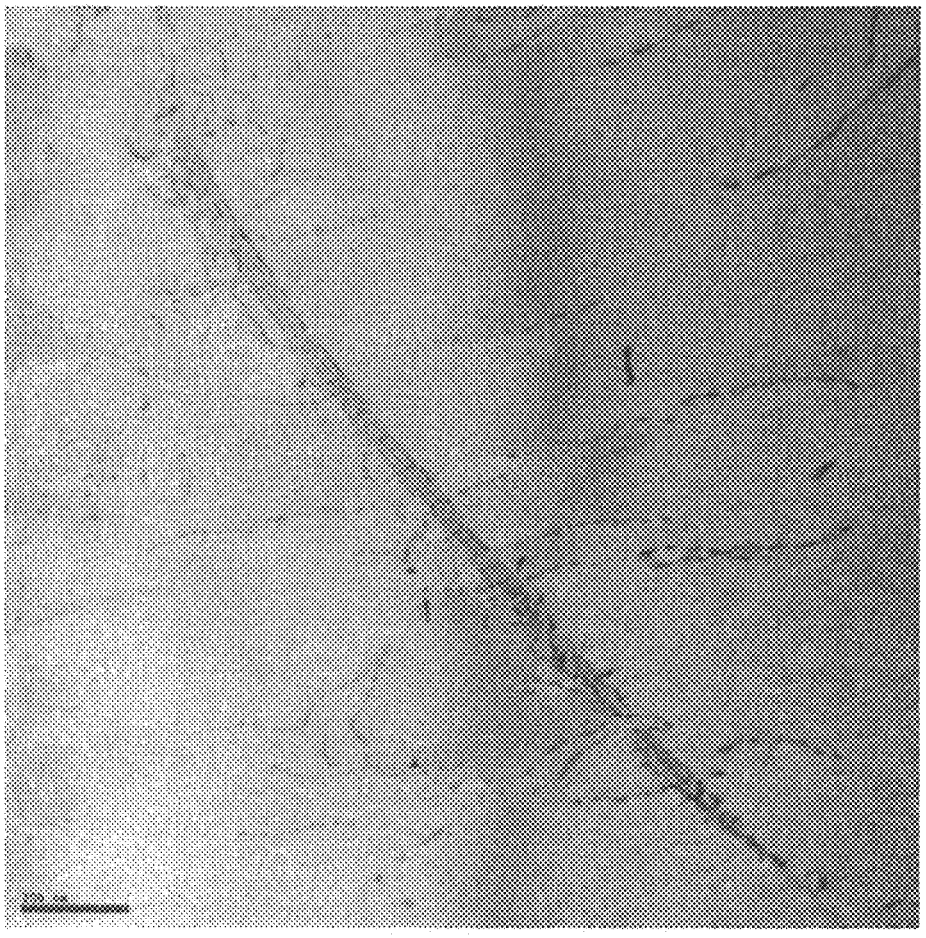
FIG. 6 depicts a carbon nanotube within a reinforced composite material. Also depicted are fine lines in the reinforced composite material around the carbon nanotube which are defects known as dislocations, which are part of the plastic deformation process.
Figure 7:
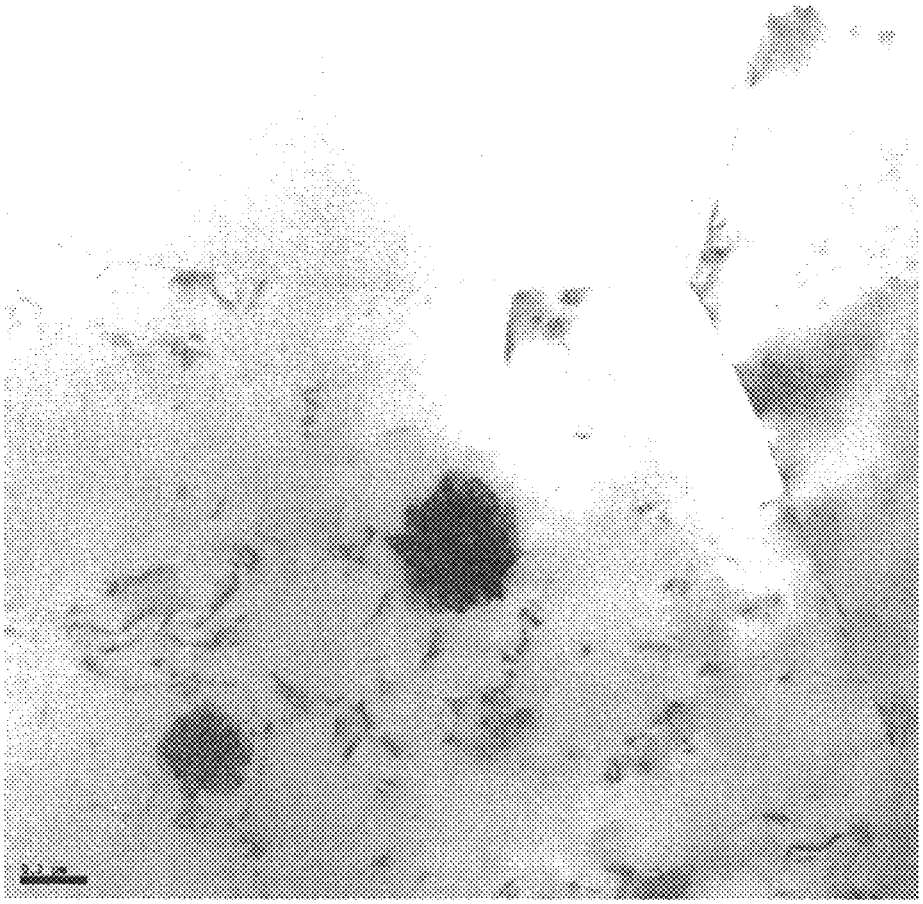
FIG. 7 depicts an aluminum oxide particle which is embedded in the reinforced composite product using the instant disclosure. These particles are roughly 200 nm in diameter.
Figure 8:
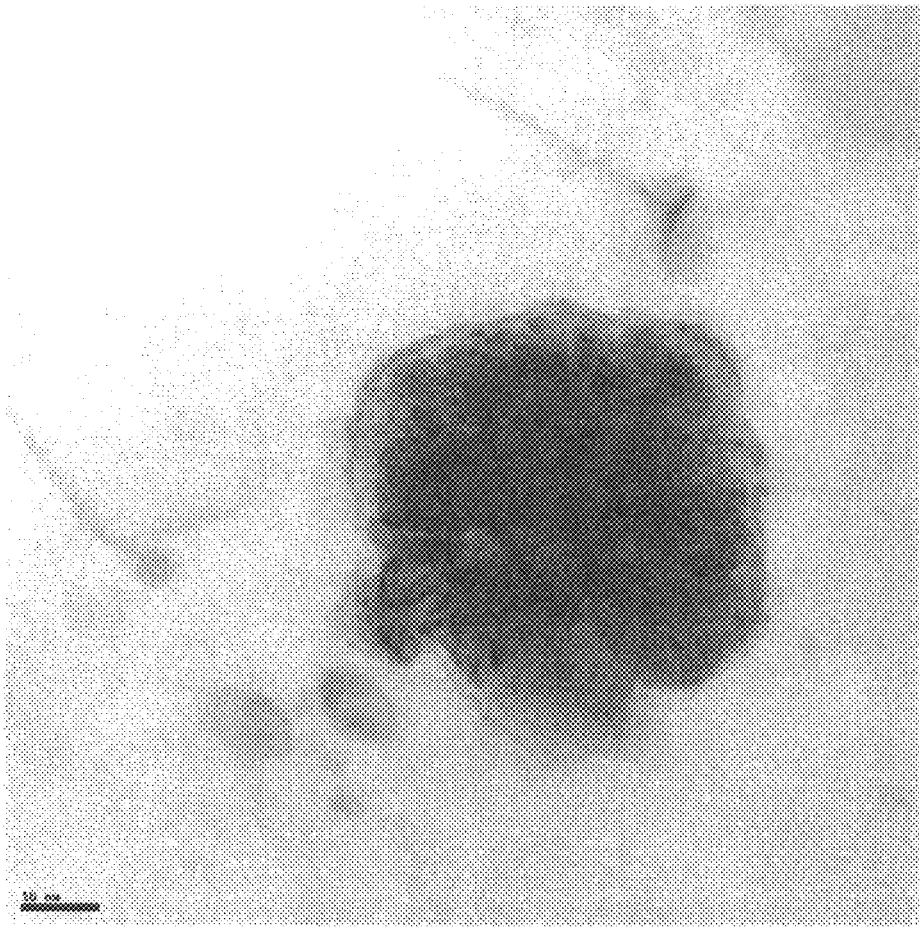
FIG. 8 depicts an aluminum oxide particle embedded within a reinforced composite product in accordance with the instant disclosure. Here, there is an interface that surrounds the aluminum particle which illustrates that the entire particle is substantially inert, but the particle has surface reactions along the outer edge. Similar to FIG. 7, FIG. 8 includes particles that are sub-micron size at roughly 200 nm.

FIG. 6 depicts silicon carbide as the sub-micron sized particle in the reinforced composite, with aluminum metal as the non-particulate metal portion.

Example 3

Reinforced Composite Containing CNTs

Samples were prepared to determine the effect of (CNT) additions on the mechanical behavior of aluminum alloys. As base line, aluminum alloy 1050 was selected. The melt was treated as described in Example 1, with the addition of 10 g CNTs to the samples were cast and the resulting volume fraction of CNTs was 0.1 vol. %. After solidification, samples were cold rolled from 1.0 gauge to 0.125" gauge, annealed at 750° F. for 15 minutes, then air cooled.

Chemical analysis verified the presence of additional carbon in the assolidified material. Transmission Electron Microscopy (TEM) imaged CNTs embedded in the aluminum matrix (FIGS. 5 and 6). SEM identified the presence of a small, well dispersed carbon-rich phase, which is believed to be the CNTs. The yield strength of the final product increased from 85 to 94 MPa. This increase is in agreement with the expected value, assuming a random distribution of CNTs and factoring in that the CNTs within approximately 10° to the loading axis will contribute to the mechanical strengthening.

Example 4

Characterization Data, Mechanical Properties, Strength, Yield Strength, Elongation The strength increase from Orowan looping for commercially pure aluminum was calculated based on Z. Zhang, D. L. Chen, Scripta Materialia 54 (2006) 1321-1326, which is incorporated herein by reference in its entirety. A knock-down factor of 15% for non-random spacing was applied to the calculated yield strength values based on U.F. Kocks Phil Mag 13, 1966, pp 541, which is incorporated herein by reference in its entirety.

The calculations are based on measured yield strength of smelter grade aluminum of 67 MPa. FIG. 11 depicts the calculated potential increases in yield strength for different volume fractions of nano-sized particles in the solid aluminum, from 0.1 vol % to 5 vol %. Particles larger than 100 nm at low volume fraction of 0.1 vol % do not show an appreciable increase in predicted yield strength. However, if at that particle size the volume fraction is increased of more than 2%, the yield strength could be doubled. A significant increase even for small volume fractions of less than 1% can be achieved if particles of smaller than 50 nm in diameter are being used. In this case yield strength values comparable to advanced heat-treatable aluminum alloys are predicted.

Figure 12:
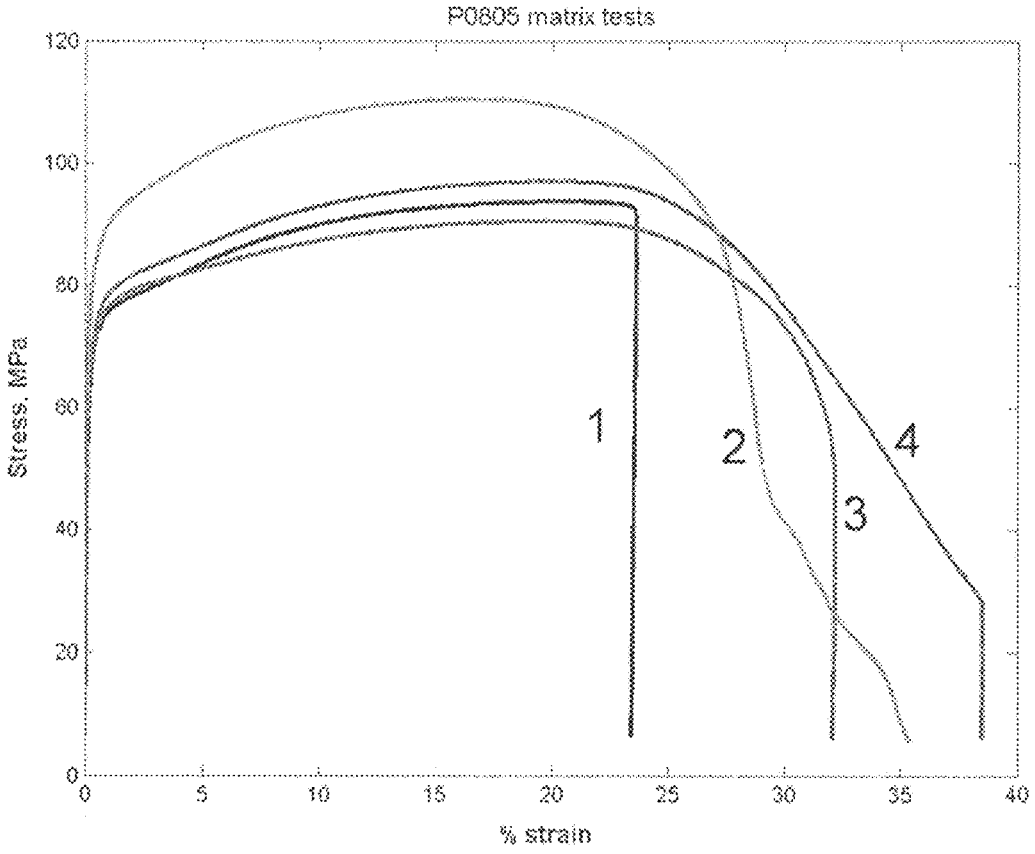
FIG. 12 depicts the stress vs. strain for 4 different samples (3 reinforced composite materials (Lines 2-4) and a control (Line 1).

Referring to FIG. 12, modified mechanical properties which result from sub-micron sized particles in the aluminum (via the embodiments of the instant disclosure) is depicted. The chart depicts the measured values, including the stress (in MPa) depicted for various % strains in a matrix test, where each line (Lines 1-4 represents a sample made in accordance with the process described in Example 1). Line 1 is the base line, which is smelter grade aluminum with no sub-micron sized particles (control). Line 2 is smelter grade aluminum with less than 1 vol. % alumina (100 nm particle size). Line 3 is smelter grade aluminum with less than 1 vol. % SiC (80 nm particle size). Line 4 is smelter grade aluminum with less than 1 vol. % of TiCN (80 nm particle size). For Line 1, once the maximum stress is reached, the line drops sharply at just above 23% strain. For Lines 2-4 (i.e. reinforced composites), the materials with sub-micron sized particles can undergo much greater stresses and/or strain before failing.

Adding about 0.5 vol % of alumina nano particles the strength increase, both yield strength and ultimate tensile strength, by 20%. Surprisingly, the strain-to-failure increased by more than 50% in all cases. (see, e.g. FIG. 12).

Example 5

Nano-Alumnina Fibers

Adding nano-alumina fibers to the melt at a melt temperature of less than 800 C using the described process resulted in nano-alumina fibers embedded in the solidified matrix (e.g. reinforced composite). Typically, alumina is considered to be non-wetting and cannot be included in a solidified metal matrix.

While various embodiments of the present invention have been described in detail, it is apparent that modifications and adaptations of those embodiments will occur to those skilled in the art. However, it is to be expressly understood that such modifications and adaptations are within the spirit and scope of the present invention.

What is claimed is:

1. A method comprising:

adding (a) a carrier comprising a salt and (b) a plurality of substantially inert sub-micron sized particles into a molten metal, wherein at least some of the plurality of substantially inert sub-micron sized particles include a contaminant on an outermost surface;

forming a mixture comprising the molten metal and the plurality of substantially inert sub-micron sized particles, wherein the salt is configured as a wetting aid to remove at least a portion of the contaminants from the substantially inert sub-micron sized particles to promote incorporation of the submicron sized particles into the melt via wetting; and producing a reinforced composite from the mixture, wherein the reinforced composite comprises a non-particulate metal portion having the substantially inert sub-micron sized particles therein;

further wherein, via the forming step, the reinforced composite includes an interface between the substantially inert sub-micron sized particles and the non-particulate metal portion that is substantially contaminant free.

2. The method of claim 1, wherein, due to the adding step, the reinforced composite comprises an oxide concentration of less than about 100 ppm in the metal portion.

3. The method of claim 1, wherein the adding step further comprises adding sub-micron sized particles selected from the group consisting of: nanoparticles, carbon nanotubes, magnetic sub-micron sized particles, non-metallic sub-micron sized particles, ceramic particles; and combinations thereof.

4. The method of claim 1, wherein the forming step comprises forming a reinforced composite product having particles with an average aspect ratio of about 1:5.

5. The method of claim 1, wherein the forming step comprises forming the reinforced composite having not greater than 25 vol. % of sub-micron sized particles.

6. The method of claim 1, wherein the forming step comprises forming the reinforced composite having not less than 0.1 vol. % of sub-micron sized particles therein.

7. The method of claim, 1, wherein the adding step further comprises mixing.

8. The method of claim 7, wherein the mixing step further comprises:

mixing the salt and at least one of: an alloying element, a grain refiner or combinations thereof.

9. The method of claim 1, further comprising: producing a metal product from the reinforced composite.

10. The method of claim 9, further wherein producing comprises:

extruding the reinforced composite.

11. The method of claim 10, wherein the extruding step comprises: forming at least one of: a rod, a bar, a tube, a wire, or combinations thereof.

12. The method of claim 10, wherein the producing step comprises: rolling the reinforced composite to form a plate, a sheet, a foil, or combinations thereof.

13. The method of claim 10, wherein the producing step comprises: casting the reinforced composite into a final shape.

14. The method of claim 1, further wherein the adding step comprises: adding a carrier substance comprising an inert gas.

15. A method comprising:

adding (a) a carrier comprising a salt and (b) a plurality of substantially inert sub-micron sized particles into a molten metal, wherein at least some of the plurality of substantially inert sub-micron sized particles are selected from the group consisting of: magnesium aluminate, magnesium hydroxide, aluminum nitride, aluminum oxide, aluminum titanate, silica, silicon dioxide, silicon nitride, calcium oxide, calcium phosphate, calcium titanate, calcium zirconate, titanium nitride, titanium silicon oxide, titanium oxide, nickel chromium oxide, nickel oxide, copper aluminum oxide, copper zinc alloy, yttrium oxide, gadolinium oxide, copper oxide, tungsten oxide, molybdenum oxide, zirconium silicate, aluminum cerium oxide, cerium oxide, tungsten, bismuth oxide, nickel, selenide, $V_2O_5$, C—BN, $WS_2$, and combinations thereof;

wherein the substantially inert sub-micron sized particles include a contaminant on an outermost surface;

forming a mixture comprising the molten metal and the plurality of substantially inert sub-micron sized particles, wherein the salt is configured to remove at least a portion of the contaminants from the substantially inert sub-micron sized particles to promote incorporation of the submicron sized particles into the melt; and producing a reinforced composite from the mixture, wherein the reinforced composite comprises a non-particulate metal portion having the substantially inert sub-micron sized particles therein;

further wherein, via the forming step, the reinforced composite includes an interface between the substantially inert sub-micron sized particles and the non-particulate metal portion that is substantially contaminant free.

16. The method of claim 15, further wherein the adding step comprises: adding a carrier substance comprising an inert gas.

17. The method of claim 15, further comprising removing a top layer from the mixture and solidifying the reinforced product.

18. The method of claim 15, further comprising: producing a metal product from the reinforced composite.

19. The method of claim 18, further wherein producing comprises:

extruding the reinforced composite to form at least one of: a rod, a bar, a tube, a wire, or combinations thereof.

20. The method of claim 15, further comprising molding the reinforced composite to form a product.

* * * * *